US011647850B2

(12) United States Patent
Farinola et al.

(10) Patent No.: US 11,647,850 B2
(45) Date of Patent: May 16, 2023

(54) ANTI-SWEEP MERCHANDISE DISPLAY HOOK

(71) Applicants: Nick Farinola, Kinnelon, NJ (US); Ansh B. Jhaveri, Irving, TX (US); Matthew J. Goebel, Fort Worth, TX (US)

(72) Inventors: Nick Farinola, Kinnelon, NJ (US); Ansh B. Jhaveri, Irving, TX (US); Matthew J. Goebel, Fort Worth, TX (US)

(73) Assignee: VIRA Insight, LLC, Lewisville, TX (US)

( * ) Notice: Subject to any disclaimer, the term of this patent is extended or adjusted under 35 U.S.C. 154(b) by 16 days.

(21) Appl. No.: 17/398,339

(22) Filed: Aug. 10, 2021

(65) Prior Publication Data

US 2023/0045967 A1 Feb. 16, 2023

(51) Int. Cl.
*A47F 5/00* (2006.01)
*A47F 5/08* (2006.01)

(52) U.S. Cl.
CPC ..... *A47F 5/0823* (2013.01); *A47F 5/0869* (2013.01)

(58) Field of Classification Search
None
See application file for complete search history.

(56) References Cited

U.S. PATENT DOCUMENTS

| | | | | | |
|---|---|---|---|---|---|
| 920,132 | A | | 5/1909 | Greener | |
| 1,033,915 | A | | 7/1912 | McDonald | |
| 4,394,909 | A | | 7/1983 | Valiulis et al. | |
| 4,850,557 | A | | 7/1989 | Valiulis | |
| 5,014,949 | A | | 5/1991 | Niven | |
| 5,259,220 | A | | 11/1993 | Fredrickson | |
| 5,275,027 | A | * | 1/1994 | Eklof | A47F 5/0861 70/38 A |
| 5,348,167 | A | | 9/1994 | Jensen | |
| 5,485,930 | A | | 1/1996 | Rushing | |
| 5,597,150 | A | | 1/1997 | Stein et al. | |
| 5,815,970 | A | | 10/1998 | Thalenfeld et al. | |
| 5,860,239 | A | * | 1/1999 | Thalenfeld | A47F 5/0869 40/642.01 |
| 5,901,487 | A | | 5/1999 | Thalenfeld et al. | |
| 5,941,003 | A | * | 8/1999 | Thalenfeld | A47F 5/0869 40/658 |
| 6,141,894 | A | * | 11/2000 | Thalenfeld | A47F 5/0869 40/658 |

(Continued)

*Primary Examiner* — Steven M Marsh
(74) *Attorney, Agent, or Firm* — Dan Brown Law Office; Daniel R. Brown

(57) ABSTRACT

A retail display hook for merchandise packaged with a hang tab aperture includes mounting bracket with a hang bar and an access bar cantilevered therefrom. The hang bar extends outwardly along a straight portion, through an upwardly peaked portion, and followed by an upwardly angled portion. An access flap pivotally engages a distal end of the access bar, and is located above and adjacent to the distal end of the hang bar. The access flap includes an arrester extension and a blocker extension. Rotation of the access flap between a display position and an access position controls removal of merchandise to one unit at a time, requiring cyclical operation to remove more than one unit.

19 Claims, 10 Drawing Sheets

(56) References Cited

U.S. PATENT DOCUMENTS

| | | | | |
|---|---|---|---|---|
| 6,269,571 | B1 * | 8/2001 | Thalenfeld | A47F 5/0869 40/642.01 |
| 7,484,628 | B2 | 2/2009 | Schneider | |
| 7,708,152 | B2 | 5/2010 | Mansfield et al. | |
| 7,743,931 | B2 * | 6/2010 | Barkdoll | A47F 5/0861 24/16 PB |
| 9,386,864 | B2 | 7/2016 | Pongrac et al. | |
| 9,468,315 | B2 * | 10/2016 | Ha | A47F 5/0861 |
| 10,694,871 | B1 * | 6/2020 | Vogler | A47F 5/0861 |
| 2011/0062092 | A1 * | 3/2011 | Casey | B23P 11/00 70/58 |
| 2013/0008863 | A1 * | 1/2013 | Valiulis | A47F 1/128 29/428 |
| 2014/0173874 | A1 * | 6/2014 | Ha | A47F 5/0861 248/551 |

* cited by examiner

20

ANTI-SWEEP MERCHANDISE DISPLAY HOOK

RELATED APPLICATIONS

None.

BACKGROUND OF THE INVENTION

Field of the Invention

The present disclosure generally relates to retail merchandise display hooks that support items of merchandise for evaluation by potential customers. More particularly, the present invention relates to display hooks that are configured to prevent the rapid removal of plural items of merchandise therefrom, which is also referred to as "product sweeping".

Description of Related Art

Merchandise display hooks have been employed by retailers for many decades, as a convenient way to support and display plural items of merchandise, typically from a gondola shelving unit. Such display hooks are designed to be cantilevered from a retail display unit, or other support structure such as a display peg board or a display rack. In this method of display, items of merchandise are commonly supported on protruding bars or rods attached to such a support structure, which may be a peg board, a slat board, a cross bar, a wire rack, or other suitable arrangement for support. These protruding rods are commonly referred to in the art as display hooks, peg board hooks, or slat board hooks. Typically, the items of merchandise are relatively small and relatively valuable, such as batteries, small tools, cosmetic products, health care products, and other valuable products. Such merchandise is an easy target for shoplifters because they can rapidly remove all the items from a display hook and leave the store without being detected, which is referred to as product sweeping in the trade. Alternately, the shoplifter can remove the entire display hook with the merchandise and leave the store. Thus, there is a need in the art for a retail merchandise display hook configured to prevent or reduce product sweeping in retail displays.

SUMMARY OF THE INVENTION

The present disclosure teaches a display hook this is attached to a retail display for presentation of merchandise packaged with hang tab apertures. The display hook includes a bar assembly with a mounting bracket for attaching to the retail display, a hang bar for hanging the merchandise by the hang tab apertures, and an access bar. The hang bar extends outwardly from the mounting bracket along a straight portion, through an upwardly peaked portion, and followed by an upwardly angled portion that terminates at a distal end thereof. The access bar also extends from the mounting bracket, and terminates with a lateral hinge pin located above and adjacent to the distal end of the hang bar. The display hook also includes an access flap that has a hinge barrel, a display face, an arrester extension and a blocker extension, all of which are in fixed orientation with each other. The hinge barrel pivotally engages the lateral hinge pin to allow rotation of the access flap between a display position and an access position. The blocker extension is oriented to interfere with removal of merchandise from the distal end of the hang bar along the upwardly angled portion while the access flat is at the display position, and also oriented to not interfere with removal of merchandise while the access flap is at the access position. The arrester extends from the access flap to interfere with movement of the merchandise over the upwardly peaked portion of the hang bar while the access flap is at the access position.

In a specific embodiment of the foregoing display hook, the access bar and the straight portion of the hang bar are aligned substantially parallel to one another. In a refinement to this embodiment, the access bar and the straight portion of the hang bar are inclined upwardly from the mounting bracket at an angle between ten and thirty degrees.

In a specific embodiment of the foregoing display hook, the arrester extension and the blocker extension are aligned horizontally and are substantially parallel to one-another while the access flap is at the display position.

In a specific embodiment of the foregoing display hook, the access flap rotates in a range of angles between thirty degree and sixty degrees between the display position to the access position. In a refinement to this embodiment, the access flap engages the hang bar at the display position to prevent rotation of the access flap beyond the range of angles while at the display position.

In a specific embodiment of the foregoing display hook, the upwardly peaked portion of the hang bar includes an upwardly inclined portion in the range of sixty to seventy degrees above the horizontal, and a downwardly inclined portion in the range of forty to fifty degrees below the horizontal, and the upwardly angled portion is in the range of forty-five to fifty-five degrees above the horizontal.

In a specific embodiment of the foregoing display hook, the hang bar and the access bar are fabricated from number five, America Wire Gauge, metallic wire, and the hinge pin is formed by bending a distal end of the access bar at a right angle.

In a specific embodiment of the foregoing display hook, the display face is oriented vertically while the access flap is at the display position, to thereby present display graphics in front of the distal end of the hang bar.

In a specific embodiment of the foregoing display hook, the display face is oriented horizontally while the access flap is at the display position, to thereby present display graphics above the distal end of the access bar.

In a specific embodiment of the foregoing display hook, the access flap is assembled from two portions that snap together, to thereby capture the lateral hinge pin and retain the access flap on the bar assembly.

In a specific embodiment of the foregoing display hook, the hang bar is finished with a textured material that resists sliding movement of the merchandise hang tab apertures along the hang bar, to thereby slow the removal of the merchandise from the hang bar.

In a specific embodiment of the foregoing display hook, the retail display is a peg board, and the mounting bracket is formed of wire to engage the peg-board.

In a specific embodiment of the foregoing display hook, the retail display includes a cross bar, and the mounting bracket is formed with an inverted slot to rest upon the cross bar of the retail display.

In a specific embodiment of the foregoing display hook, the mounting bracket includes a set-screw for securing the display hook to the retail display.

In a specific embodiment of the foregoing display hook, the mounting bracket includes a spring loaded button clip for securing the display hook to the retail display.

In a specific embodiment of the foregoing display hook, the mounting bracket includes a ratchet clip for securing the display hook to the retail display.

The present disclosure teaches a method of displaying and accessing merchandise packaged with hang tab apertures using a display hook that includes a bar assembly with a mounting bracket, a hang bar, and an access bar, where the hang bar extends outwardly from the mounting bracket along a straight portion, through an upwardly peaked portion, and followed by an upwardly angled portion, and where the access bar extends from the mounting bracket and terminates with a lateral hinge pin located above and adjacent to the distal end of the hang bar, and where the display hook also includes an access flap that includes a hinge barrel, a display face, an arrester extension and a blocker extension, all of which are in fixed orientation with each other. The method includes pivotally engaging the hinge barrel about the lateral hinge pin, thereby facilitating rotation of the access flap between a display position and an access position. The method also includes orienting the blocker extension to interfere with removal of merchandise from the distal end of the hang bar along the upwardly angled portion while the access flat is at the display position, and also orienting the blocker extension to not interfere with removal of merchandise while the access flap is at the access position. Further, orienting the arrester extension from the access flap to interfere with movement of the merchandise over the upwardly peaked portion of the hang bar while the access flap is at the access position.

In a further refinement, the foregoing method includes attaching the display hook to a retail display by engaging the mounting bracket with the retail display unit, and hanging plural items of merchandise from the hang bar. Then, positioning the access flap at the display position, and rotating the access flap to the access position, and then sliding a first item of merchandise off the distal end of the hang bar, to thereby retrieve the first item of merchandise. And, rotating the access flap to the display position, and sliding a second item of merchandise over the upwardly peaked portion of the hang bar, thereby preparing for retrieval of the second item of merchandise.

DESCRIPTION OF THE INVENTION

Figure 1:
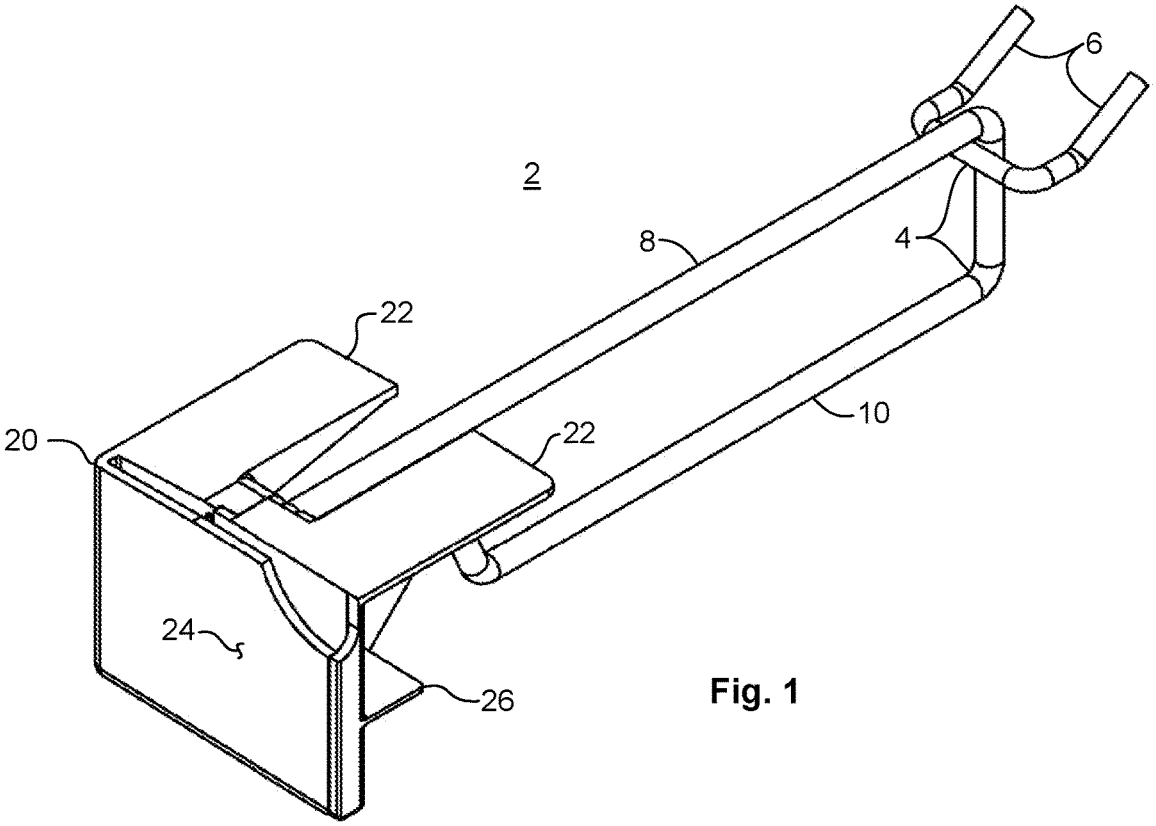
FIG. 1 is a perspective view drawing of an anti-sweep display hook in the display position according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present disclosure presents a range of novel retail display hooks that exhibit plural features which resist threats of product sweeping, while still providing a conveniently accessible display for ordinary customers who typically purchase products one unit at a time. The intended products are merchandise of the type packaged on a substrate, clam-shell, card or such, which has a hang tab aperture, such as a hole punched therethrough. A hang bar on the display hook supports the merchandise by the hang tab aperture, and plural units of merchandise may be placed on each hang bar, which are then removed in sequence from the front. The hang bar of the illustrative embodiment has a serpentine, or sawtooth, formed distal end, such that the merchandise must be rotated a bit and routed up and down to be removed from the distal end of the hang bar. This design requires a coordinated effort on the part of the consumer to remove, and also makes it particularly challenging to remove more than one package at a time. This feature of the display hook is augment by employing a textured finish, such as spattered paint or powder coating finish, or one that is mechanically formed on the hang bar surface, which serves to provide some resistance to the rapid removal, by sliding, of the merchandise. These security features are further augmented by the incorporation of an access flap at the distal end of the display hook.

The access flap is hinged to a distal end of an access bar, and located adjacent the distal end of the hang bar. The arrangement is such that the access flap naturally rests, under the force of gravity, or under spring force, at a display position. A blocker extension fixed to the access flap extends to a location where the path of the packaged merchandise is blocked near the distal end of the hang bar, and cannot be removed. In order to access the merchandise, the customer must manually rotate the access flap to an access position. At the access position, the blocker extension is rotated away from the distal end of the hang bar such that the package merchandise can easily be slid off the end of the hang bar. Simultaneously, as the access flap is rotated, an arrester extension is positioned to block movement of the next merchandise package through the serpentine portion of the hang bar. Thus, a second unit of merchandise cannot be slid off the end of the hang bar until the access flap is returned to the display position and that items is routed over the serpentine portion of the hang bar. In this manner, the advancement and removal of each unit of packaged merchandise is cyclical, requiring two operations by the customer. First, rotation to the access position and removal of the front-most item, followed by return to the display position where the next item can be advanced, and so forth.

In addition the aforementioned security features, the access flap of the illustrative embodiment is provided with a display face where product information and price may be placed. This information can be attached with an adhesive arrangement, or may be sandwiched between a support surface and a transparent display surface. The orientation of the display face may be vertical, horizontal, and any angle in between. This enables retailers to select a display angle most suitable for comfortable viewing by customers. For example, on a lower display unit, a horizontal display may be preferred. And, at a higher position, such at eye-level, a vertical display position may be preferred.

In a particular illustrative embodiment, an anti-theft peg display hook is taught, which comprises a hook assembly that is attached to a shelving system, and an access flap assembly that is attached to the hook assembly. The hook assembly has a peg connector at a proximal end, with an upper bar and a lower bar extending therefrom. The upper bar terminates with a cross bar bend at its distal end, and the lower bar terminates with a sawtooth bend at its distal end. The two bars are closely spaced, one above the other, and may be provided with a coarse-textured finish. The access flap assembly comprises a left hand portion and a right hand portion that snap together to retain them on the upper bar crossbar end, and together present a display face. The access flap includes a pivot that engages the crossbar to define a lateral axis of rotation such that the access flap assembly can pivot during loading and unloading of product onto the lower bar, the two positions referred to as the display position and the access position. The access flap assembly includes two rearward extensions from a display face, these extensions include an arrester and a blocker. In the display position, both extension align horizontally. In the access position, both extensions rotate to approximately 45° downwardly from the horizontal. In the display position, the arrester allows movement of product along the lower bar and over the sawtooth portion, however, the blocker prevents removal of any product until the access flap assembly is rotated. Once rotated, the blocker moves away from the end of the lower bar such that the front most product may be removed from the end of the lower bar. As the access flap assembly is rotated, the arrestor moves downwardly and interferes with forward movement of the next product hung from the lower bar, thereby preventing its movement over the sawtooth portion until the flipper assembly is again rotated to the display position. In this manner, only a single product may be removed with each cycling of the flipper assembly.

In this disclosure, reference is made to the horizontal, and this means horizontal with respect to the force of gravity. That is a plane orthogonal to the direction of gravity, such as the surface of a still liquid. Angular measure herein are taken with respect the horizontal plane. The terms above and below are taken with respect to the direction of gravity as well, such as an item above another would fall down to the item below by force of gravity. Where the terms proximal and distal are employed, they are taken with respect to the support structure to which and access hook is attached, where proximal means the end closest to the support structure and distal means the end further away from the support structure.

Reference is directed to FIG. 1, which is a perspective view drawing of an anti-sweep display hook 2 in the display position according to an illustrative embodiment of the present invention. The display position, as illustrated, is the normal, resting, position for display of merchandise (not illustrated), as a customer would experience when first approaching the retail display. The display hook 2 includes a bar assembly 4, which is comprised of a mounting bracket 6, a hang bar 10, and an access bar 8. Note that in this embodiment, the mounting bracket 6 is a peg board mount fabricated from metal wire bent into the shape illustrated. The hang bar 10 and access bar 8 are also fabricated from bent metallic wire and finished with a textured surface (not illustrated). At the distal end of the bar assembly 4 is an access flap 20, which pivotally engages the distal end of the access bar 8. The access flap 20 includes a display surface 24, which is vertically oriented at the display position in this embodiment, as illustrated. Extending to the rear of the display surface 24 is an arrester extension 22 and a blocker extension 26. In the display position, the arrester extension does not interfere with movement of merchandise (not illustrated) along the hang bar 10. The blocker extension 26 does prevent removal of merchandise from the distal end of the hang bar 10, and this will be more fully detailed hereinafter.

Figure 2:
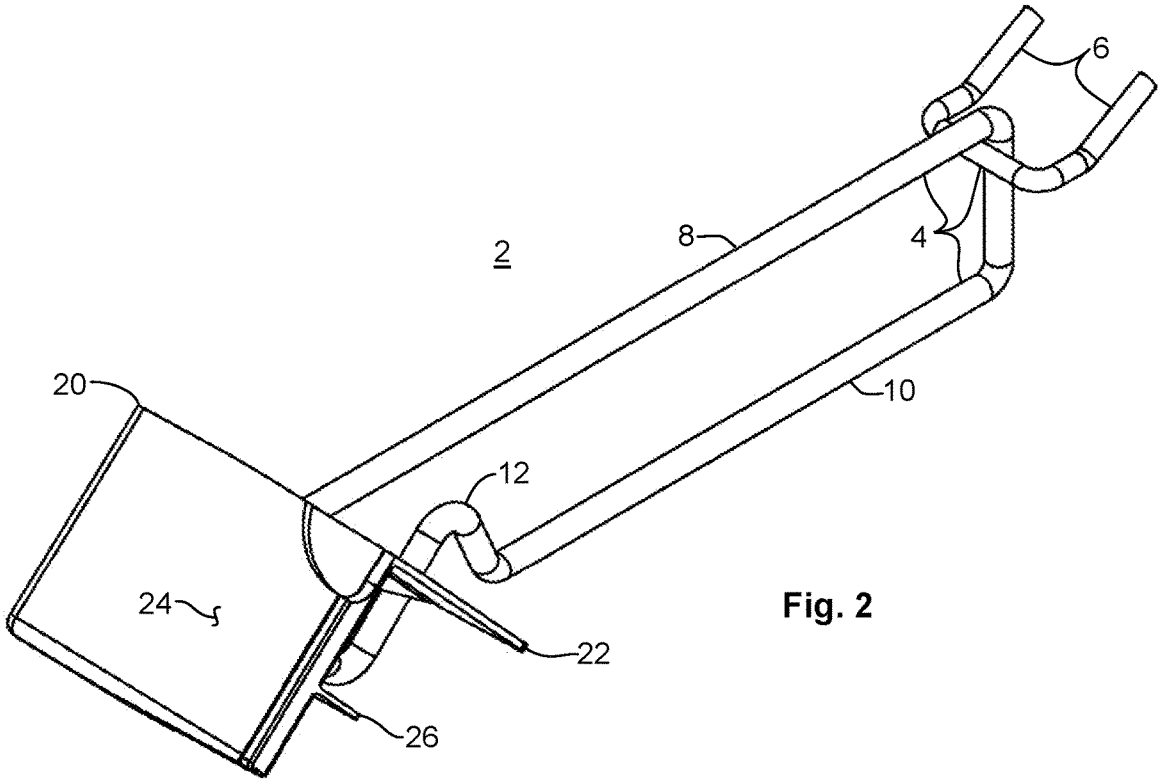
FIG. 2 is a perspective view drawing of an anti-sweep display hook in the access position according to an illustrative embodiment of the present invention.

Reference is directed to FIG. 2, which is a perspective view drawing of an anti-sweep display hook 2 in the access position according to an illustrative embodiment of the present invention. This FIG. 2 corresponds with FIG. 1, where FIG. 2 shows the access flap 20 rotated to the access position, as illustrated, which would be manually accomplished by a customer seeking to remove and item of merchandise (not illustrated). In the access position, the display face 24 is angled upwardly while the arrester extension 22 and blocker extension 26 are rotated downwardly. By this rotation, the blocker extension 26 is moved away from the distal end of the hang bar 10 such the that front most item of merchandise (not illustrated) can be slid off the distal end of the hang bar 10 and retrieved for purchase by the customer. On the other hand, the arrester extension 22 is rotated to interfere with movement of the next item of merchandise (not illustrated) forward from removal.

Figure 3A:
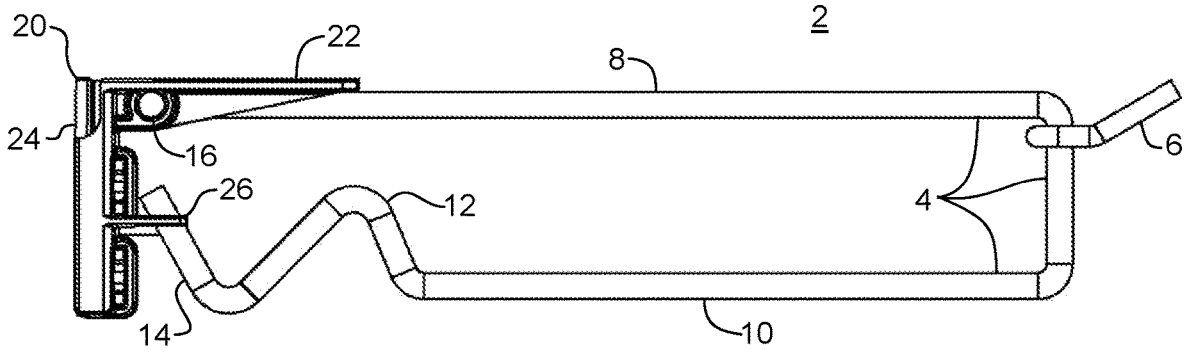
FIGS. 3A, 3B, and 3C are side view drawing, a top view drawing, and a front view drawing, respectively, of an anti-sweep display hook according to an illustrative embodiment of the present invention.
Figure 3B:
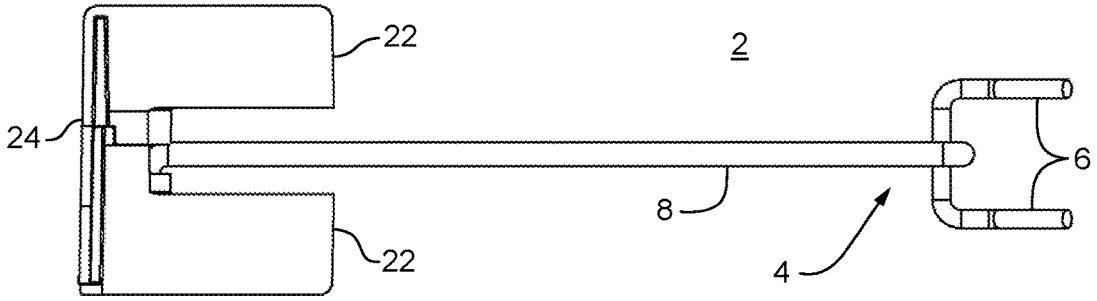
Figure 3C:
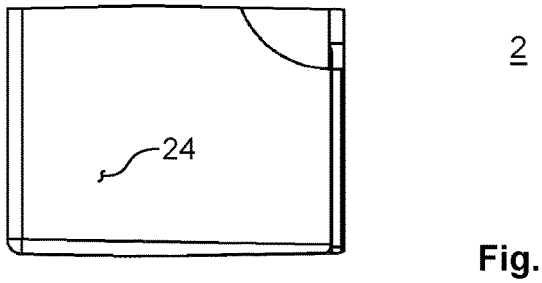

Reference is directed to FIGS. 3A, 3B, and 3C, which are side view drawing, a top view drawing, and a front view drawing, respectively, of an anti-sweep display hook 2 according to an illustrative embodiment of the present invention. The display position is illustrated in these views, which is the normal resting position. The balance of the access flap 20 is such that gravity will hold this position naturally, although a light spring may be employed to urge the access flap 20 to this position if needed. The display hook 2 includes the bar assembly 4, which is comprised of a mounting bracket 6, a hang bar 10, and an access bar 8. The display hook to also includes the access flap 20, which is pivotally engaged with the distal end of the access bar 8. Note that the hang bar 10 includes an upwardly peaked bend 12 and an upwardly angled portion 14 at its distal end. Further note that the access bar 8 has a lateral hinge pin 16, which is formed by bending the distal end of the access bar at a right angle. The access flap 20 includes a display surface 24, which is vertically oriented at the display position in this embodiment, as illustrated. Extending to the rear of the display surface 24 is an arrester extension 22 and a blocker extension 26, which are aligned horizontally and in parallel with one another in this embodiment. In the display position, the arrester extension does not interfere with movement of merchandise (not illustrated) along the hang bar 10. The blocker extension 26 does prevent removal of merchandise from the distal end of the hang bar 10, and this will be more fully detailed hereinafter.

Figure 4:
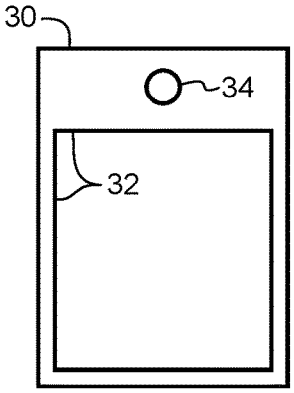
FIG. 4 is a drawing of an item of merchandise including a hand tab aperture.

Reference is directed to FIG. 4, which is a drawing of an item of merchandise including a hand tab aperture. This illustrates a typical item of merchandise that may be displayed on a display hook of the present disclosure. The merchandise 32 is displayed on a substrate or package 30 that includes a hang tab aperture 30, which may be a hole punched therethrough. An example is a pack of four size AA electric batteries near the checkout aisle of the big box retailer.

Figure 5A:
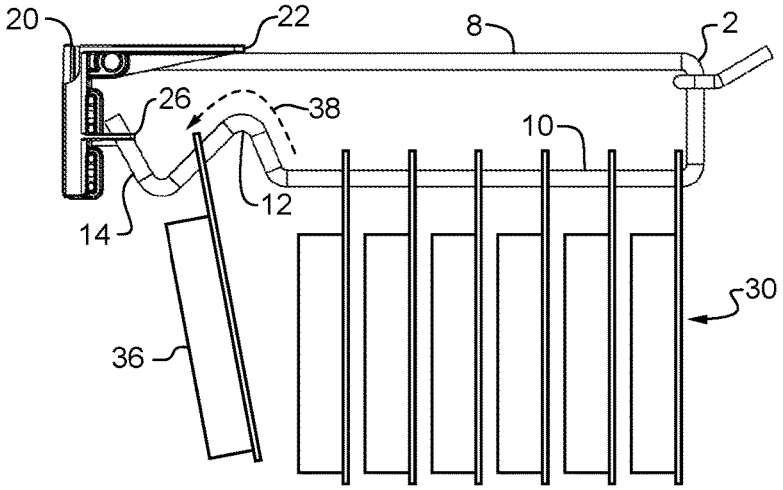
FIGS. 5A, 5B, and 5C are side view drawings illustrating merchandise advancement, merchandise display, and merchandise access, respectively, according to an illustrative embodiment of the present invention.
Figure 5B:
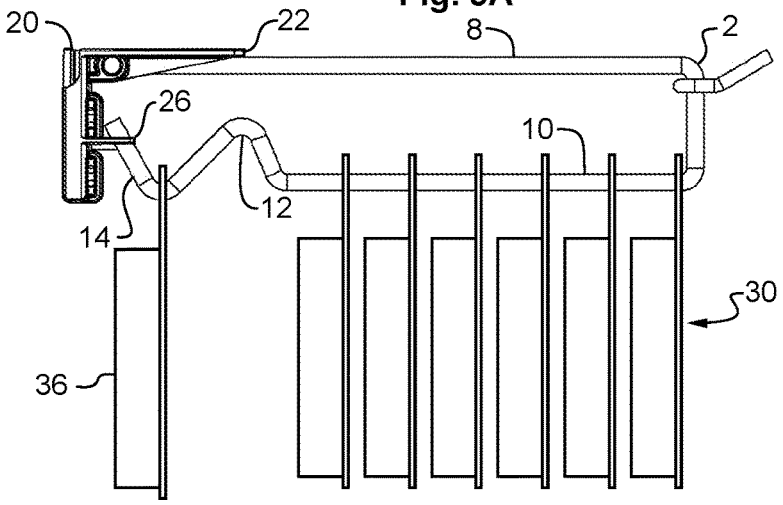
Figure 5C:
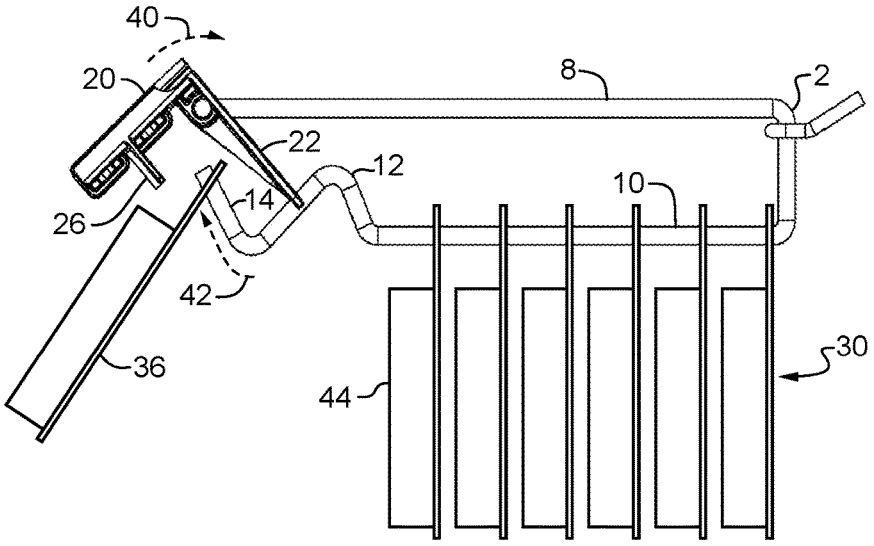

Reference is directed to FIGS. 5A, 5B, and 5C, which are side view drawings illustrating merchandise advancement, merchandise display, and merchandise access, respectively, according to an illustrative embodiment of the present invention. In all three figures, the display hook 2 is illustrated in side view, and show the hang bar 10, the access bar 8, and the access flap 20. Plural items of merchandise 30 are hung from the hang bar 10. The front most item of merchandise is labeled as item 36, and the second to the front most time of merchandise is labeled as item 44. The hang bar 10 includes an upwardly peaked portion 12 and an upwardly angled portion 14, as illustrated. The access flap 20 includes rearward extending arrester extension 22 and blocker extension 26.

In FIG. 5A, the display hook is illustrated in the display position where the access flap 20 rests with the blocker and arrester extensions 22, 26 in a horizontal orientation. The arrester extension 22 has no effect on merchandise 30, 36 movement, however, the blocker extension 26 interferes with movement of merchandise 36 off the end of the upwardly angled portion 14 of the hang bar 10. The front most item of merchandise 36 may be rotated 38 over the upwardly peaked portion 12, and moved forwardly to rest between the upwardly peaked portion 12 and the upwardly angled portion 14, which is presented in FIG. 5B. This is the action needed to ready the display after a previously removed item of merchandise (not illustrated) has been removed by a prior customer.

In FIG. 5C, a customer has elected to retrieve the front most item of merchandise 36 from the display hook 2. In order to do this, the access flap 20 is rotated 40 upwardly, which simultaneously rotates the blocker extension 26 and the arrester extension 22 downwardly, as illustrated. Rotation of the blocker extension 26 moves it away from the distal end of the upwardly angle portion 14 such that the merchandise 36 may be removed 42 from the display hook 2 and taken for purchase. At the same time, rotation of the arrester extension 22 interferes with movement of the next item of merchandise 44 over the upwardly peak portion 12. In order to advance the next item 44, it would necessary to release the access flap 20, allowing it to rotate back the the display position, essentially returning to the condition illustrated in FIG. 5A. And so forth.

Figure 6:
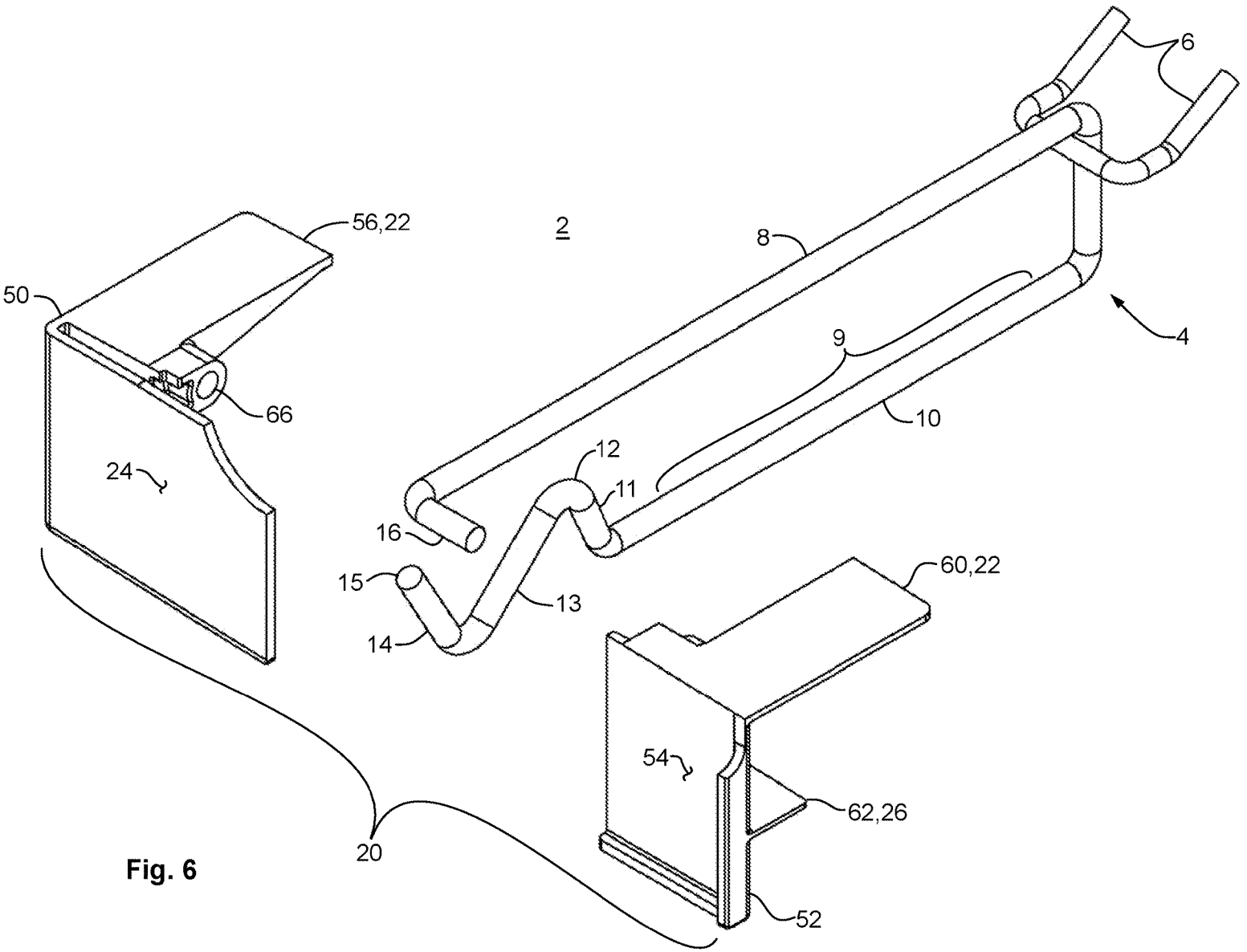
FIG. 6 is an exploded perspective view drawing of an anti-sweep display hook according to an illustrative embodiment of the present invention.

Reference is directed to FIG. 6, which is an exploded perspective view drawing of an anti-sweep display hook 2 according to an illustrative embodiment of the present invention. The bar assembly 4 and access flap 20 are illustrated. The bar assembly 4 consists of a mounting bracket 6 as described hereinbefore, the hang bar 10 and the access bar 8. The hang bar 10 extends from the mounting bracket 6 in a substantially horizontal direction along a straight portion 9, through an upwardly peaked portion 12, and through an upwardly angled portion 14 terminating at a distal end 15. Note that the upwardly peaked portion 12 includes an upwardly inclined portion 11 and a downwardly inclined portion 13, which together define the upwardly peaked portion 12. The access bar 8 also extends horizontally from the mounting bracket 6 and terminates at a distal end with a lateral hinge pin 16, which if formed by bending the access bar 8, as illustrated. The location of the hinge pin is above and adjacent to the distal end 15 of the hang bar 10.

The access flap 20 in FIG. 6 is comprised of two portions, a left-hand portion 50 and a right-hand portion 52, which join together to form a complete access flap 20. The two portions 50, 52 join together with ratchet pawl clips in one side the engage slots formed in the other side, which will be more fully detailed hereinafter. The two portions 50, 52 join together about the hinge pin 16 at the distal end of the access bar 8, which is captured by a hinge boss 66 on the left-hand portion 50. The right-had portion 50 comprises a portion of a display backing 54, and the left-hand portion comprises the display window 24, as illustrated. The display window 24 may be fabricated from transparent plastic to facilitate viewing graphic materials captured between the display backing 54 and the display window 24. The left-hand portion 50 includes a portion 56 of the arrester extension 22, and, the right-hand portion 52 includes a portion 60 of the arrester extension 22. When the two portions 50, 52 are joined, the two arrester extension portions 56, 60 define a gap therebetween, which provides a space for the arrester extension 22 to straddle the access bar 8 and the hang bar 10, thereby enabling the blocking functionality described elsewhere herein. The same applies to the blocker extension 26, however only one of the portions 62 is visible in this perspective view drawing.

Figure 7A:
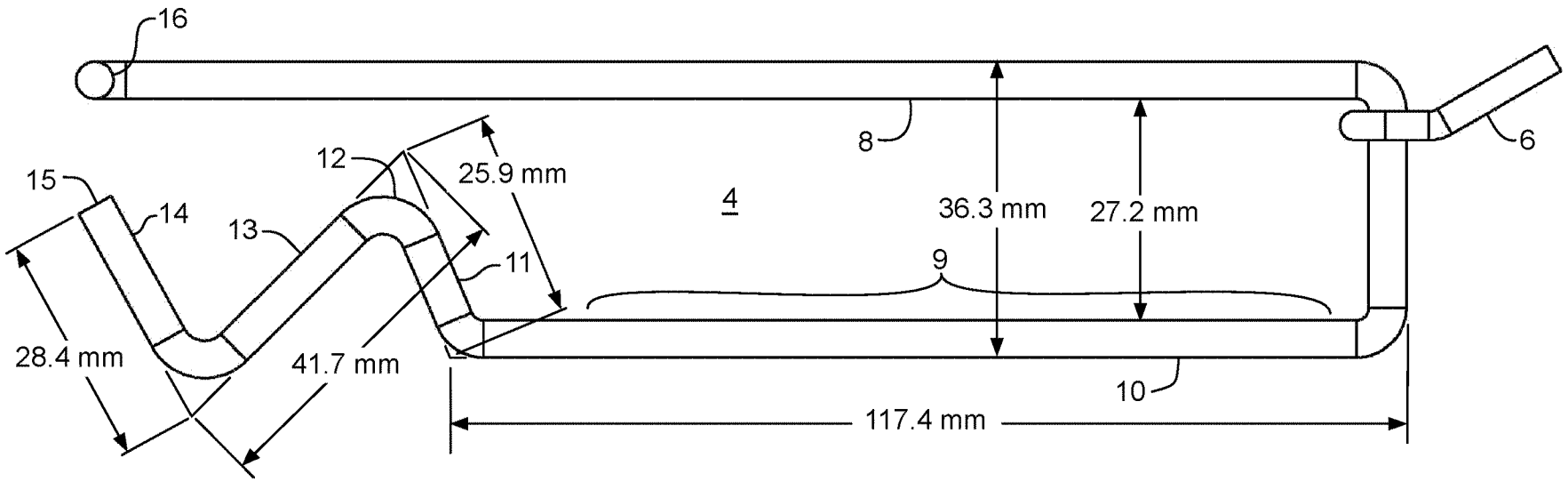
FIGS. 7A and 7B are side view drawings of a bar assembly according to an illustrative embodiment of the present invention.
Figure 7B:
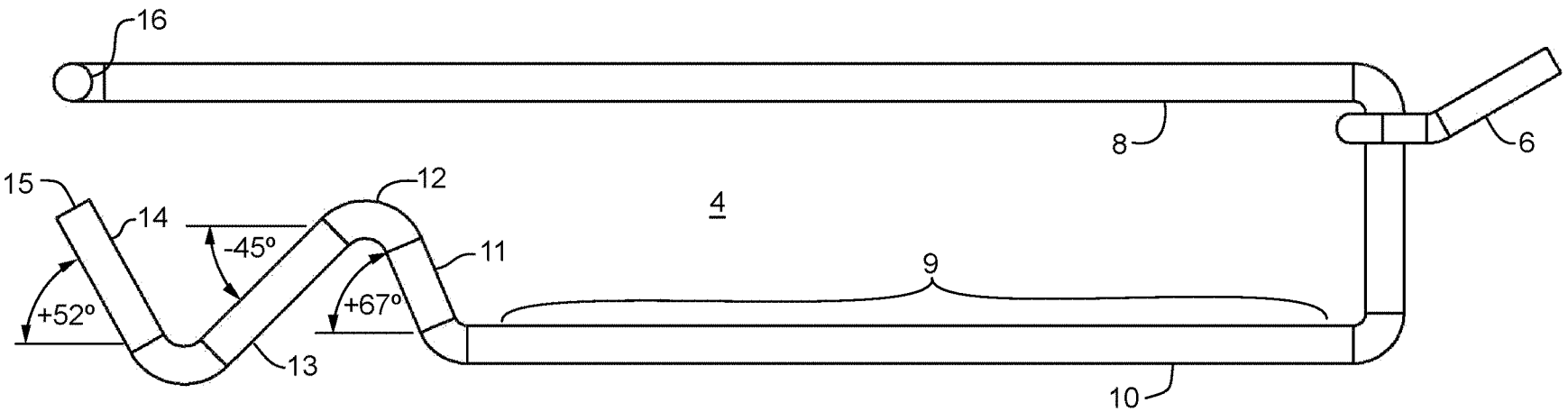

Reference is directed to FIGS. 7A and 7B, which are side view drawings of a bar assembly 4 according to an illustrative embodiment of the present invention. As with the prior descriptions the mounting bracket 6 is located at the proximal end of the assembly 4, and the hang bar 10 and access bar 8 extend therefrom in cantilever. The access bar 10 is generally straight and terminates at its distal end with a lateral hinge pin 16 formed by bending the bar. In the illustrative embody, the access bar 8 and hand bar 10 are formed of number 5, America Wire Gauge, metallic wire. The hang bar 10 extends from the boating bracket 6 along a straight portion 9 to the upwardly peaked portion 12, which is comprised of an upwardly including portion 11 followed by a downwardly inclined portion 13. This is then followed by an upwardly angled portion 14 to a distal end 15. Note the lengths and angles of these portions illustrated in FIGS. 7A and 7B, which represent the preferred embodiment. Although a broader range of angles are operative, including the range of sixty to seventy degrees above the horizontal for the upwardly inclined portion 11, a the range of forty to fifty degrees below the horizontal for the downwardly inclined portion 13, and range of forty-five to fifty-five degrees above the horizontal upwardly angled portion 14.

Figure 8A:
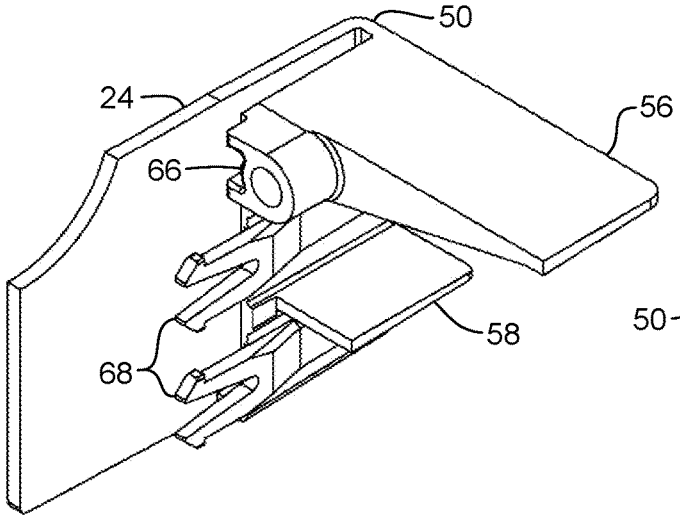
FIGS. 8A and 8B are perspective view drawings of a first portion of an access flap according to an illustrative embodiment of the present invention.
Figure 8B:
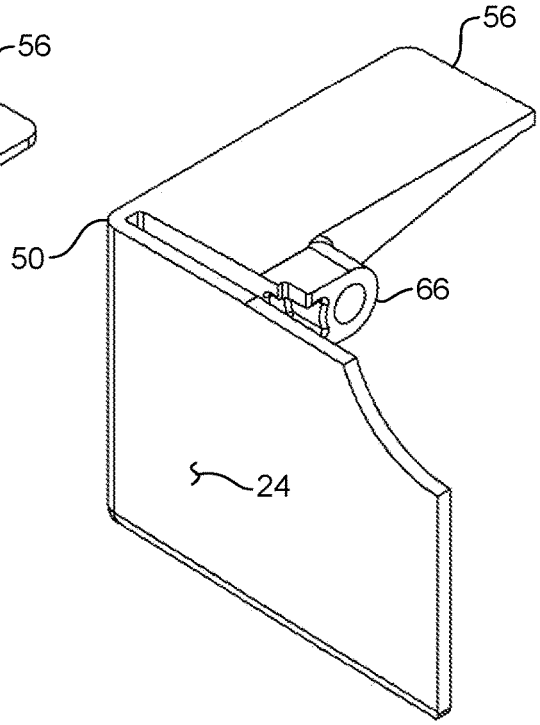

Reference is directed to FIGS. 8A and 8B, which are perspective view drawings of a left-hand (LH) portion of an access flap 20 according to an illustrative embodiment of the present invention. FIG. 8A showing a rear view perspectives and FIG. 8B showing a front view perspective. The LH portion 50 includes the display face 24, which may be fabricated from transparent plastic, and which is fabricated in fixed relation with a LH portion 56 of the arrester extension, and a LH portion 58 of the blocker extension. A hinge boss 66 is provided to capture the lateral hinge pin of the access bar (not illustrated) when the LH portion 50 and RH portion 52 of the access flap 20 are joined thereabout. The LH portion 50 also presents a pair of ratchet clip extensions 68, which engage corresponding assembly slots (item 70 in FIGS. 9A and 9B) when assembled.

Figure 9A:
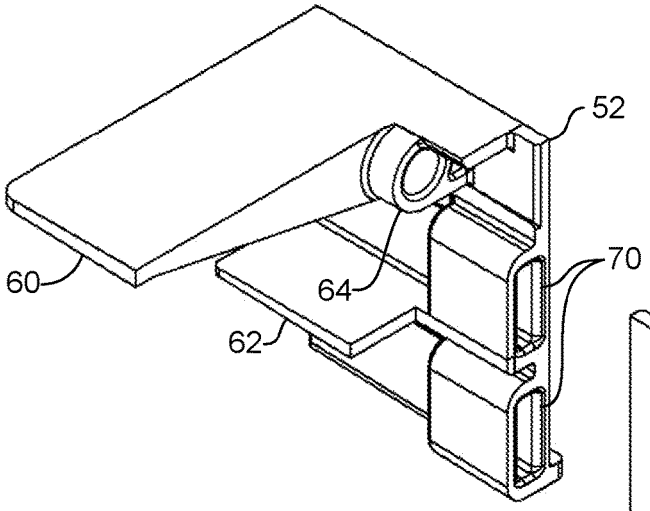
FIGS. 9A and 9B are perspective view drawings of a second portion of an access flap according to an illustrative embodiment of the present invention.
Figure 9B:
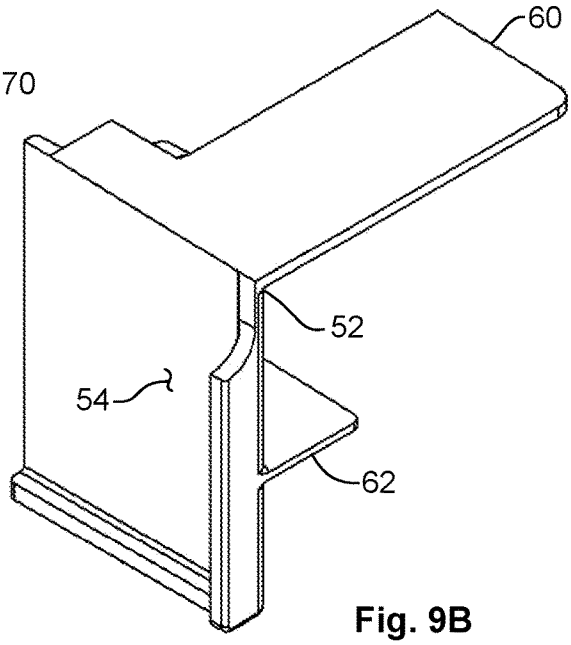

Reference is directed to FIGS. 9A and 9B, which are perspective view drawings of a right-hand (RH) portion 52 of an access flap 20 according to an illustrative embodiment of the present invention. FIG. 9A showing a rear view perspectives and FIG. 9B showing a front view perspective. The RH portion 52 includes the display backing 54, which is fabricated in fixed relation with a RH portion 60 of the arrester extension, and a RH portion 62 of the blocker extension. A hinge barrel 64 is provided to pivotally engage the lateral hinge pin of the access bar (not illustrated, item 16 in FIG. 6) when the LH portion 50 and RH portion 52 of the access flap 20 are joined thereabout. The RH portion 52 also presents a pair of assembly slots 70, which engage the ratchet clip extensions 68 in FIGS. 8A, when assembled. When the two portions 50, 52 are joined, the two arrester extension portions 56, 60 define a gap therebetween, which provides a space for the arrester extension to straddle the access bar 8 and the hang bar 10, thereby enabling the blocking functionality described elsewhere herein. Likewise, when the two portions 50, 52 are joined, the two blocker extension portions 58, 62 define a gap therebetween, which provides a space for the blocker extension to straddle the access bar 8 and the hang bar 10

Figure 10:
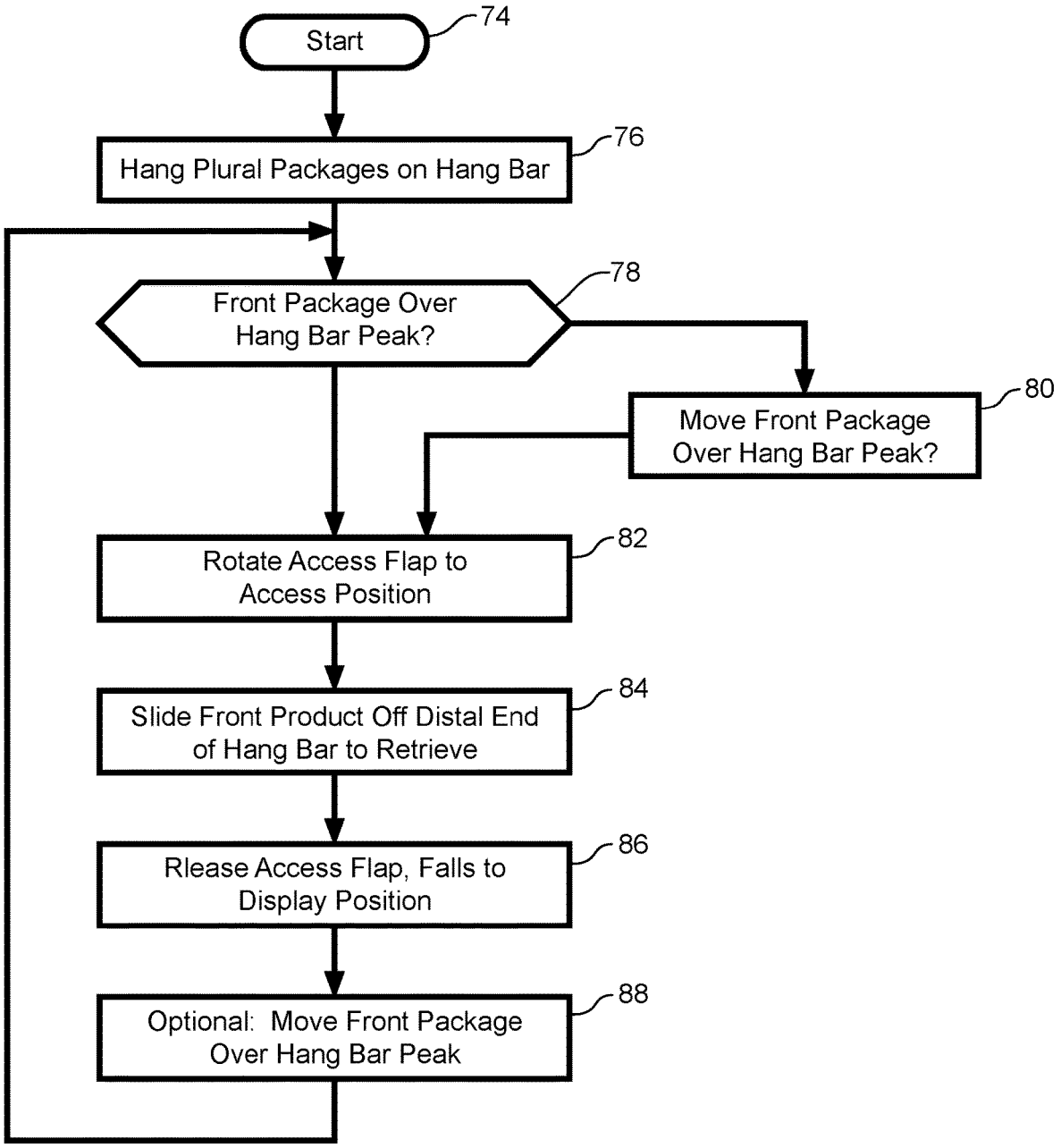
FIG. 10 is process flow diagram of the use of an anti-sweep merchandise display hook according to an illustrative embodiment of the present invention.

Reference is directed to FIG. 10, which is process flow diagram of the use of an anti-sweep merchandise display hook according to an illustrative embodiment of the present invention. The process begins at step 74 and proceeds to step 76 where plural items of merchandise are hung upon the hang bar of the display hook, thus 'loading' the display for retail customers. At step 78, the customer inspects the display hook to determine if the front-most item has been moved over the upwardly peaked portion of the hang bar. If so, flow precedes to step 82. In not, flow proceeds to step 80 where the customer manually moves the front-most item over the upwardly peaked portion to advance it for removal. In either case, at step 82, the customer rotates the access flap from the display position to the access position, which effects the requisite changes in the function of both the arrester extension and the blocker extension. This enables the operation at step 84, with the blocker extension out of the way, for the customer to slide the front-most item off the distal end of the hang bar. At step 86, the customer releases the display flap, which falls back to the display position. At step 88, the customer may optionally slide the second-most product forward over the upwardly peaked portion of the hang bar to ready it for the next customer. The process then returns to step 88.

Figure 11:
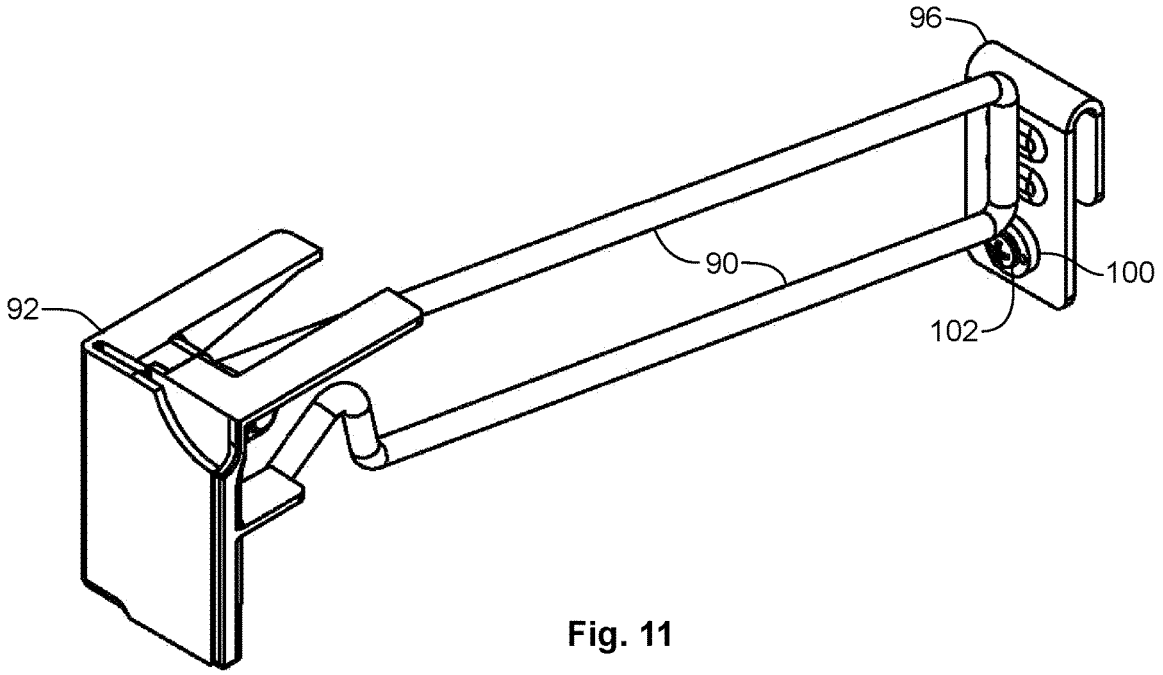
FIG. 11 is a perspective view drawing of an anti-sweep display hook in the display position according to an illustrative embodiment of the present invention.
Figure 12:
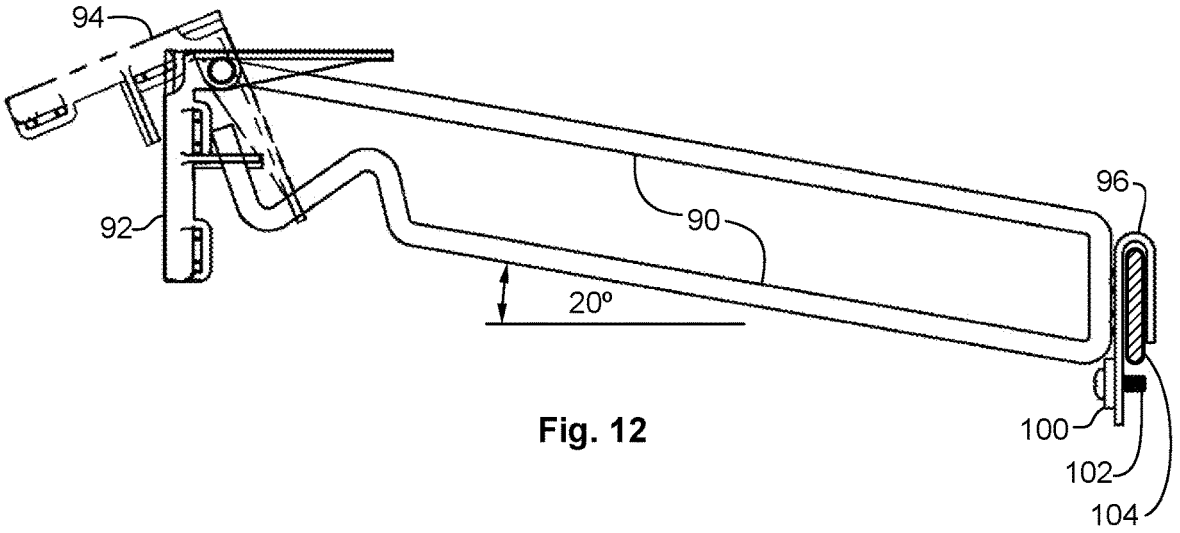
FIG. 12 is a side view drawing of an anti-sweep display hook in the display and access positions according to an illustrative embodiment of the present invention.
Figure 14C:
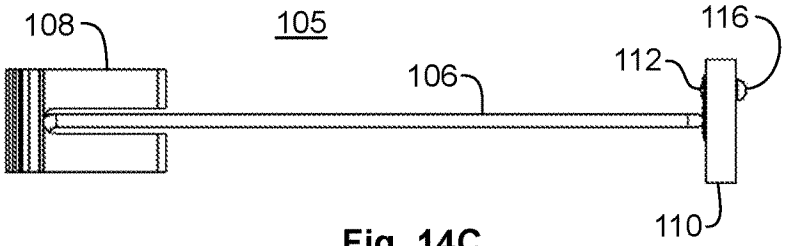
FIGS. 14A, 14B, and 14C are a side view drawing, a front view drawing, and a top view drawing, respectively, of an anti-sweep display hook in the display position according to an illustrative embodiment of the present invention.
Figure 14A:
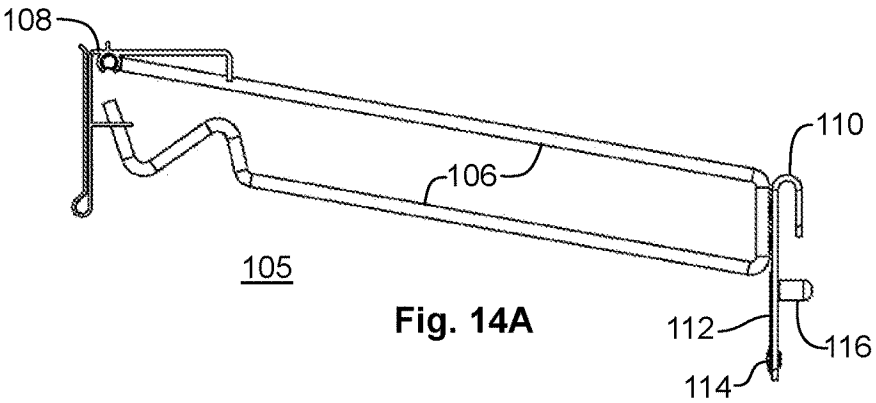
Figure 13:
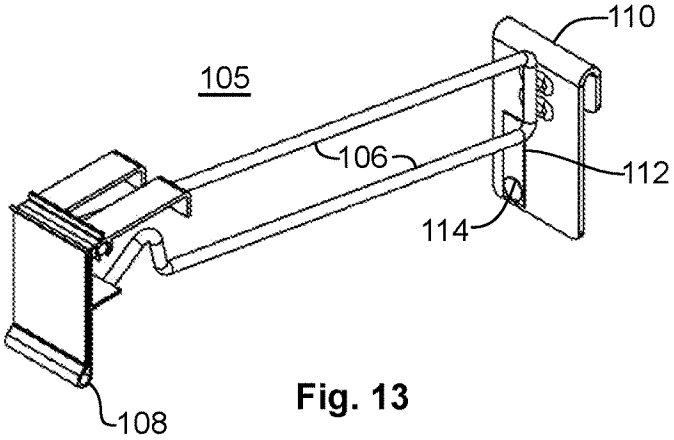
FIG. 13 is a perspective view drawing of an anti-sweep display hook in the display position according to an illustrative embodiment of the present invention.
Figure 14B:
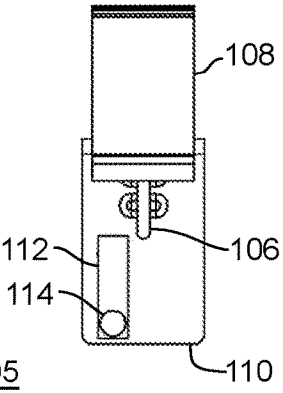

Reference is directed to FIG. 11 and FIG. 12, which are a perspective view drawing and a side view drawing, respectively, of an anti-sweep display hook in the display position, and showing the access position, according to an illustrative embodiment of the present invention. This embodiment is directed to an alternative mounting bracket for attachment to a retail display cross bar 104, as are known to those skilled in the art. In this embodiment, the bar assembly 90 supports the access flap 92 in the manner previously described herein. Where it differs is in the mounting bracket 96 and the use of an inclined bar assembly 90. With respect to the bar assembly 90, the bars are inclined upwardly from the mounting bracket 96 at an angle of approximately twenty degrees above the horizontal. This is useful in the presentation and stacking the the merchandise (not illustrated), as will be appreciated by those skilled in the presentation of retail merchandise. Note that the function of the access flap 92 is essentially unchanged, regardless of the the display position, including the access position shown in phantom as item 94. With respect to the voting bracket 96, it is formed in the shape of an inverted 'U' for placement over the display cross bar 104, which carries the loads involved. An added measure of security is provided in the form of a set screw 102, which is inserted into a threaded fitting 100, such as a press-nut, in a lower portion of the bracket 96. This screw 102 extends far enough to prevent removal of the bracket 96 from the cross bar 104, thereby preventing threat of the entire display hook and all of its merchandise.

Reference is directed to FIGS. 13, 14A, 14B, and 14C, which are a perspective view drawing, a side view drawing, a front view drawing, and a top view drawing, respectively, of an anti-sweep display hook 105 in the display position according to an illustrative embodiment of the present invention. This embodiment is directed to another alternative mounting bracket 110 for attachment to a retail display cross bar (not illustrated). In this embodiment, the bar assembly 106 supports the access flap 108 in the manner previously described herein. Where it differs is in the mounting bracket 110 and the use of an inclined bar assembly 106. With respect to the mounting bracket 110, it is formed in the shape of an inverted 'U' for placement over the display cross bar, which carries the loads involved. An added measure of security is provided in the form of a spring loaded push button 116, which extends to interfere with removal of the bracket 110 from the cross bar (not illustrated). A strap of spring metal 112 is fixed to the bracket 110 using a rivet, screw, or the like 114. The spring 112 extends to a push button 116 in form of a boss that extends to secure the display hook 105 in place until the button 116 is pressed out of the way for removal. This arrangement prevents theft of the entire display hook 105 and all of its merchandise (not illustrated).

Figure 15A:
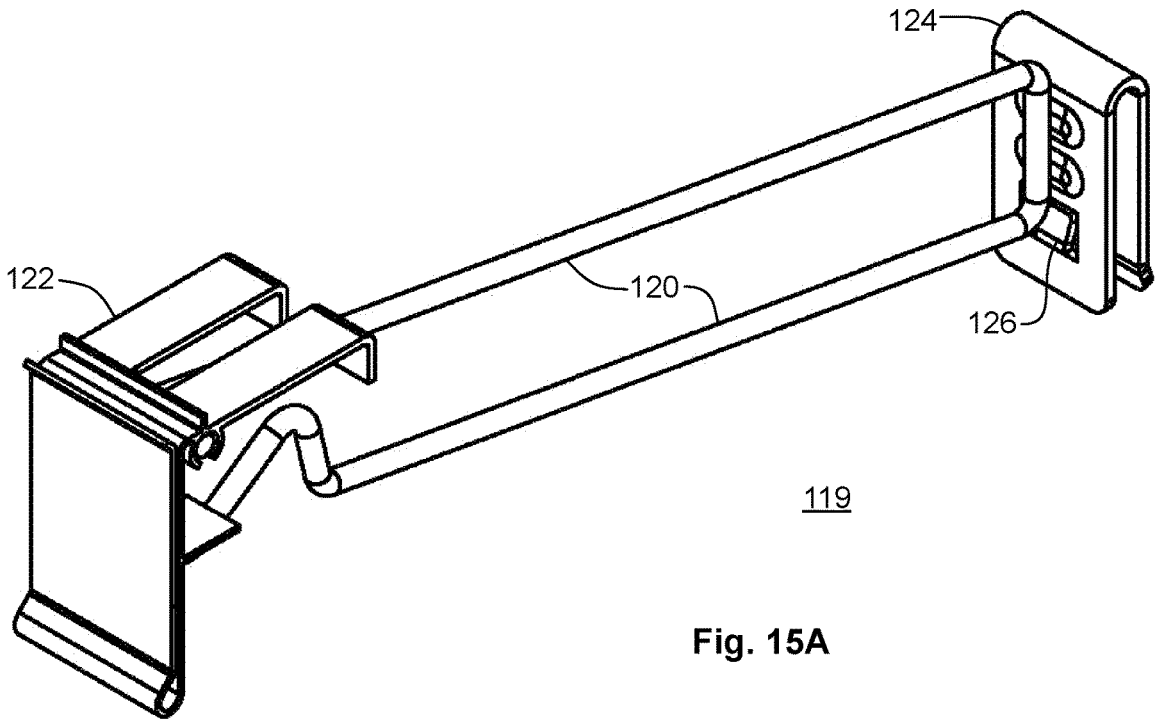
FIGS. 15A and 15B are a perspective view drawing and a side view drawing, respectively, of an anti-sweep display hook in the display position according to an illustrative embodiment of the present invention.
Figure 15B:
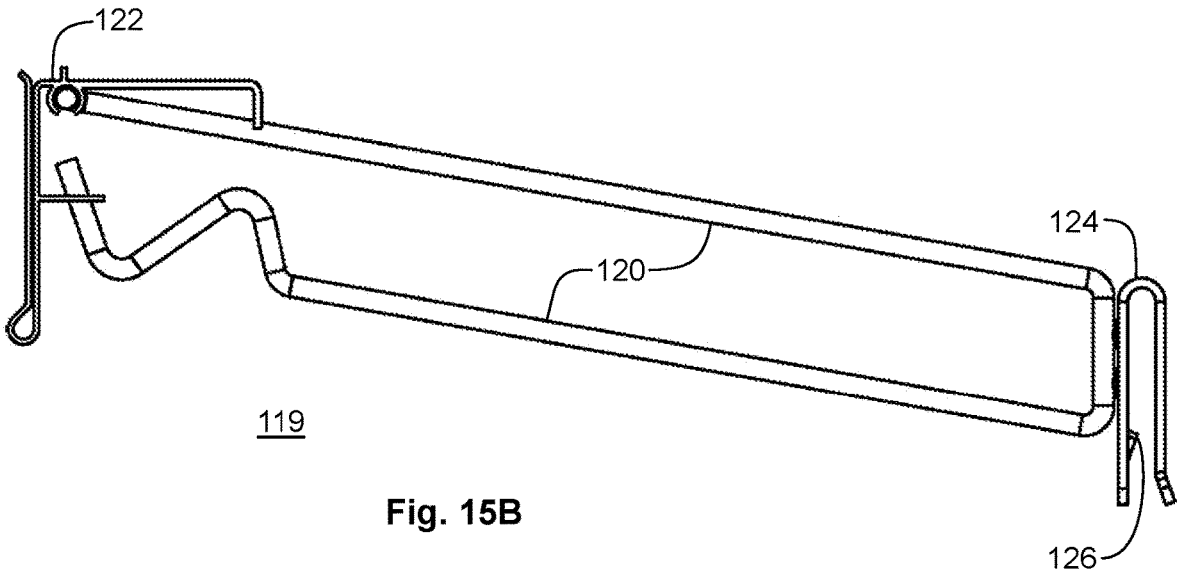

Reference is directed to FIGS. 15A and 15B, which are a perspective view drawing and a side view drawing, respectively, of an anti-sweep display hook 119 in the display position according to an illustrative embodiment of the present invention. This embodiment is directed to another alternative mounting bracket 124 for attachment to a retail display cross bar (not illustrated). In this embodiment, the bar assembly 120 supports the access flap 122 in the manner previously described herein. Where it differs is in the mounting bracket 124 and the use of an inclined bar assembly 120. With respect to the mounting bracket 124, it is formed in the shape of an inverted 'U' for placement over the display cross bar, which carries the loads involved. An added measure of security is provided in the form of a ratchet clip 126, which extends to interfere with removal of the bracket 124 from the cross bar (not illustrated). To effect removal, the bracket 124 is flexed to clear the ratchet clip 126 out of the way to remove the display hook 119 from the cross bar (not illustrated). This arrangement prevents theft of the entire display hook 119 and all of its merchandise (not illustrated).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A display hook attachable to a retail display, for presentation of merchandise packaged with hang tab apertures, the display hook comprising:

a bar assembly having a mounting bracket for attachment to the retail display, and a hang bar for hanging the merchandise by the hang tab apertures, and an access bar, and wherein said hang bar extends outwardly from said mounting bracket along a straight portion, through an upwardly peaked portion, and followed by an upwardly angled portion that terminates at a distal end thereof, and wherein;

said access bar extends from said mounting bracket, and terminates with a lateral hinge pin located above and adjacent to said distal end of said hang bar, and an access flap having a hinge barrel, a display face, an arrester extension and a blocker extension, all in fixed orientation with each other, and wherein said hinge barrel pivotally engages said lateral hinge pin to facilitate rotation of said access flap between a display position and an access position, and wherein said blocker extension is oriented to interfere with removal of merchandise from said distal end of said hang bar along said upwardly angled portion while said access flap is at said display position, and oriented to not interfere with removal of merchandise while said access flap is at said access position, and wherein said arrester extends from said access flap to interfere with movement of the merchandise over said upwardly peaked portion of said hang bar while said access flap is at said access position.

2. The display hook of claim 1, and wherein:

said access bar and said straight portion of said hang bar are aligned substantially parallel to one another.

3. The display hook of claim 2, and wherein:

said access bar and said straight portion of said hang bar are inclined upwardly from said mounting bracket at an angle between ten and thirty degrees.

4. The display hook of claim 1, and wherein:

said arrester extension and said blocker extension are aligned horizontally and substantially parallel to one-another while said access flap is at said display position.

5. The display hook of claim 1, and wherein:

said access flap rotates in a range of angles between thirty degree and sixty degrees between said display position to said access position.

6. The display hook of claim 5, and wherein:

said access flap engages said hang bar at said display position to prevent rotation of said access flap beyond said range of angles at said display position.

7. The display hook of claim 1, and wherein:

said upwardly peaked portion of said hang bar includes an upwardly inclined portion in the range of sixty to seventy degrees above the horizontal, and a downwardly inclined portion in the range of forty to fifty degrees below the horizontal, and wherein said upwardly angled portion is in the range of forty-five to fifty-five degrees above the horizontal.

8. The display hook of claim 1, and wherein:

said hang bar and said access bar are fabricated from number five, America Wire Gauge, metallic wire, and wherein said hinge pin is formed by bending a distal end of said access bar at a right angle.

9. The display hook of claim 1, and wherein:

said display face is oriented vertically while said access flap is at said display position, to thereby present display graphics in front of said distal end of said hang bar.

10. The display hook of claim 1, and wherein:

said display face is oriented horizontally while said access flap is at said display position, to thereby present display graphics above said distal end of said access bar.

11. The display hook of claim 1, and wherein:

said access flap comprises two portions that snap together, to thereby capture said lateral hinge pin and retain said access flap on said bar assembly.

12. The display hook of claim 1, and wherein:

said hang bar is finished with a textured material that resists sliding movement of the merchandise hang tab apertures along said hang bar, to thereby slow the removal of the merchandise from said hang bar.

13. The display hook of claim 1, wherein the retail display is a peg board, and wherein:

said mounting bracket is formed of wire to engage the peg-board.

14. The display hook of claim 1, wherein the retail display includes a cross bar, and wherein:

said mounting bracket is formed with an inverted slot to rest upon the cross bar of the retail display.

15. The display hook of claim 1, and wherein:

said mounting bracket includes a set-screw for fixedly attaching the display hook to the retail display.

16. The display hook of claim 1, and wherein:

said mounting bracket includes a spring loaded button clip for fixedly attaching the display hook to the retail display.

17. The display hook of claim 1, and wherein:

said mounting bracket includes a ratchet clip for fixedly attaching the display hook to the retail display.

18. A method of displaying and accessing merchandise packaged with hang tab apertures using a display hook having a bar assembly with a mounting bracket, a hang bar, and an access bar, wherein the hang bar extends outwardly from the mounting bracket along a straight portion, through an upwardly peaked portion, and followed by an upwardly angled portion, and terminating at a distal end thereof, and wherein the access bar extends from the mounting bracket and terminates with a lateral hinge pin located above and adjacent to the distal end of the hang bar, and wherein the display hook also includes an access flap having a hinge barrel, a display face, an arrester extension and a blocker extension, all in fixed orientation with each other, the method comprising the steps of:

pivotally engaging the hinge barrel about the lateral hinge pin, thereby facilitating rotation of the access flap between a display position and an access position;

orienting the blocker extension to interfere with removal of merchandise from the distal end of the hang bar along the upwardly angled portion while the access flat is at the display position, and orienting the blocker extension to not interfere with removal of merchandise while the access flap is at the access position, and extending the arrester extension from the access flap to interfere with movement of the merchandise over the upwardly peaked portion of the hang bar while the access flap is at the access position.

19. A method of claim 18, comprising the further steps of:

attaching the display hook to a retail display by engaging the mounting bracket with the retail display unit;

hanging plural items of merchandise from the hang bar, and positioning the access flap at the display position;

rotating the access flap to the access position;

sliding a first item of merchandise off the distal end of the hang bar, thereby retrieving the first item of merchandise;

rotating the access flap to the display position, and sliding a second item of merchandise over the upwardly peaked portion of the hang bar, thereby preparing for retrieval of the second item of merchandise.

* * * * *